United States Patent [19]

Harenberg

[11] Patent Number: 4,577,378

[45] Date of Patent: Mar. 25, 1986

[54] BUCKLE FOR SAFETY BELTS

[75] Inventor: Holger Harenberg, Rellingen, Fed. Rep. of Germany

[73] Assignee: Autoflug GmbH, Rellingen, Fed. Rep. of Germany

[21] Appl. No.: 623,175

[22] Filed: Jun. 21, 1984

[30] Foreign Application Priority Data

Jun. 21, 1983 [DE] Fed. Rep. of Germany ..... 3322164

[51] Int. Cl.[4] ..... A44B 11/26

[52] U.S. Cl. ..... 24/635; 24/633; 24/637; 24/639

[58] Field of Search ..... 24/633–642; 292/DIG. 73, DIG. 56; 16/86 A, 85, 86 R, 86 B

[56] References Cited

U.S. PATENT DOCUMENTS

| | | | |
|---|---|---|---|
| 1,292,310 | 1/1919 | Gravel | 16/86 B |
| 1,684,662 | 9/1928 | Day et al. | 16/85 |
| 1,820,323 | 8/1931 | Powell | 24/633 |
| 1,825,357 | 9/1931 | Lasselsberger | 24/635 |
| 2,688,173 | 9/1954 | Van Peet | 24/634 X |
| 3,181,215 | 5/1965 | Eberhart | 24/637 |
| 3,623,194 | 11/1971 | Claeson et al. | 24/635 |
| 3,981,519 | 9/1976 | Cataldo | 24/633 X |
| 4,060,879 | 12/1977 | Takada | 24/637 |
| 4,317,263 | 3/1982 | Föhl | 24/635 |
| 4,334,341 | 6/1982 | Krautz et al. | 24/635 |

FOREIGN PATENT DOCUMENTS

| | | | |
|---|---|---|---|
| 1458244 | 11/1966 | France | 24/635 |

*Primary Examiner*—William E. Lyddane
*Assistant Examiner*—Laurie K. Cranmer
*Attorney, Agent, or Firm*—Becker & Becker, Inc.

[57] ABSTRACT

A buckle for safety belts, especially in motor vehicles. The buckle has a housing and a tongue which can be inserted in an opening of the latter, can be locked in the housing by at least one latching member, and is stressed by a spring-loaded ejector. To be prevented is the technical of the rattling against one another of the housing and the buckle tongue. For this purpose, at least one spring element is disposed in the housing in the vicinity of the insertion opening for the buckle tongue. At least one abutment surface of the spring element projects laterally into the path which is to be traversed by the buckle tongue upon insertion in such a way that the tongue is acted upon transverse to the direction of insertion or ejection.

28 Claims, 6 Drawing Figures

BUCKLE FOR SAFETY BELTS

BACKGROUND OF THE INVENTION

1. Field of the Invention

The present invention relates to a buckle for safety belts for passenger carrying vehicles. The buckle has a housing and a tongue which can be inserted into an opening of the housing, can be locked in the housing by at least one latching member, and is stressed by a spring-loaded ejector.

2. Description of the Prior Art

Belt buckles of this general type are known, for example, from German Auslegeschrift No. 21 60 089, U.S. Pat. No. 3,807,000, and German Gebrauchsmusters Nos. 74 38 663 and 75 25 646. Common to all of these heretofore known belt buckles is that when driving over uneven ground, rattling noises result due to the vibrations in the drive area of the associated automobile, aircraft, etc. These noises are generated because the metallic buckle tongue can carry out small movements in the buckle housing. Attempts have been made to muffle these noises by partially surrounding the buckle tongue with plastic, and/or by producing certain parts of the housing from plastic (German Offenlegungsschrift No. 31 28 139). Due to structural and production reasons, clearance or play between the buckle housing and the inserted buckle tongue also exist in this case, so that the aforementioned movements are not precluded, and rattling repeatedly occurs. As a result, comfort while traveling is adversely affected.

An object of the present invention is to provide a buckle for safety belts of passenger carrying vehicles, especially automobiles, whereby such rattling noises no longer can result. At the same time, the corresponding measures should be realized at low expense.

BRIEF DESCRIPTION OF THE DRAWINGS

These objects, and other objects and advantages of the present invention, will appear more clearly from the following specification in conjunction with the accompanying drawings, in which.

SUMMARY OF THE INVENTION

Figure 1:
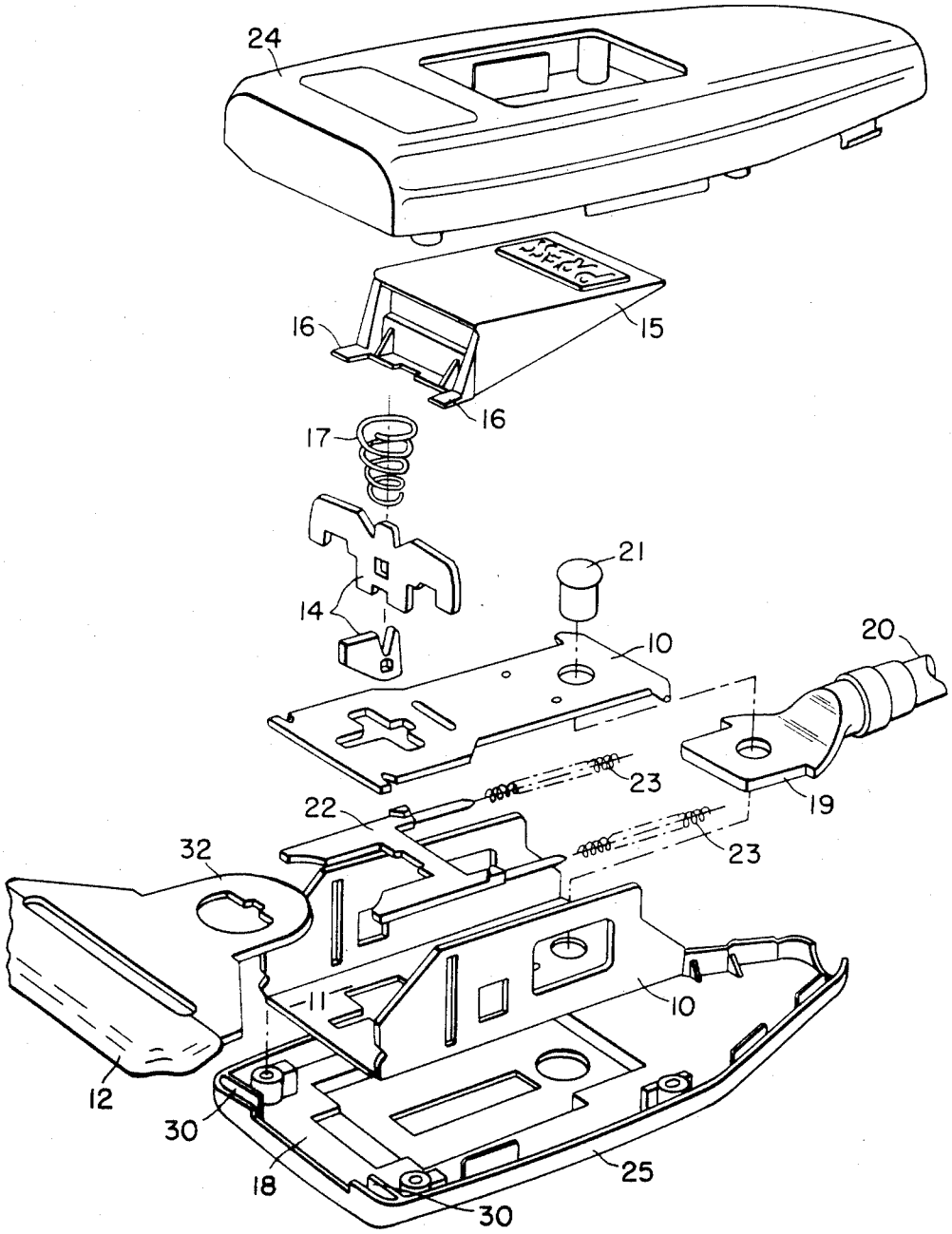
FIG. 1 is a simplified exploded view of a belt buckle for an automobile safety belt.

The buckle of the present invention is characterized primarily in that at least one spring element is disposed in the vicinity of the insertion opening in the buckle housing for the buckle tongue; at least one abutment surface of each spring element projects laterally into the path which is to be traversed by the buckle tongue upon insertion in such a way that the tongue is acted upon transverse to its direction of insertion or ejection.

Pursuant to advantageous specific embodiments of the present invention, a spring element may be disposed on both of the narrow sides of the insertion opening in the buckle housing for the buckle tongue. The spring elements may be disposed symmetrically to the longitudinal central axis of the buckle housing and/or to the path for the buckle tongue, and may have an appropriate mirror-inverted design.

With regard to that location at which the latching member engages in the buckle tongue, the spring elements may be disposed in the buckle housing in such a way that the buckle tongue contacts the spring elements shortly before it reaches the latching position, and as the buckle tonque reaches the aforementioned position the buckle tongue stresses the spring elements and the buckle tongue is thus prestressed. The spring elements may be shaped in such a way, and/or may be disposed in the buckle housing in such a way, that said spring element act upon the buckle tongue with a force component which is essentially directed at right angles to and onto the narrow lateral surfaces thereof. The spring elements also may be shaped in such a way, and/or may be disposed in the buckle housing in such a way, that said spring elements also act upon the buckle tongue with a force component which acts counter to the direction of insertion of the tongue.

The spring element or elements may have an approximately S-shape, with the S-path being disposed in or parallel to the plane of the buckle tongue, and with the upper S-curve acting upon the buckle tongue on the affected said thereof with respective force components counter and transverse to the direction of insertion. That curve of the S-configuration of the spring element which contacts the buckle tongue is straight and is provided with an outwardly open groove for receiving the edge of the buckle tongue. The groove of the spring element may have a trapezodial cross section which widens toward the outside. The S-shaped spring element may be band-like with a flat, rectangular cross section, with the inner space of the insertion opening in the buckle housing being closed off toward the side by the spring element. The outer end of the S-configuration of the spring element, when viewed relative to the insertion opening, may continue by means of a flange-like extension which is bent over toward the interior of the housing. The flange-like extension may be formed onto the spring element at such an angle that the closure of the insertion opening for the buckle tongue is effected with prestress at the affected sides thereof by means of the spring element. That end of the S-shaped spring element which is directed toward the interior of the buckle may be provided with an extension which serves as an abutment surface for further parts of the buckle housing. This extension may embrace a holding rib of the buckle housing and may fix the position of the spring element in the housing.

The spring element or elements, at the location where they contact the buckle tongue, may be provided with a configuration which overlaps the tongue and essentially fixes the position thereof at right angles to the plane of the tongue. The spring elements may have such a configuration, and/or be disposed in the-puckle housing in such a way, that said spring elements act upon the buckle tongue with a force component which is essentially directed at right angles to the main surface of the tongue. The spring elements may be provided with portions which project into the insertion path of the buckle tongue and which are provided with surfaces which rise in the direction toward the exterior of the buckle.

The spring elements may be provided with ramp-like extensions which, in the locked or latched state of the buckle, are positively connected with corresponding projections of the push button. The projections of the push button stress the ramp-like extensions of the spring elements in the direction toward the buckle tongue, thus securely holding the latter. The spring elements may be provided with members for transferring the clamping forces into the buckle housing. These members may extend in the buckle housing essentially in the longitudinal direction of the buckle, and at the same time may be provided with portions for laterally guiding the ejector.

The shape of the spring elements, with regard to curvature, length, build-up of material, and/or distance from adjacent parts of the housing with which said spring elements come in contact when said elements are displaced is such that during insertion of the buckle tongue, and during of the path of the buckle tongue up to the moment of engagement, the spring forces change, and in particular are reduced to such an extent prior to the engagement that the engagement can be clearly felt by the person buckling-up. The coordination of the spring elements with the components which are being acted upon is such that the clamping forces of the spring elements are immediately reduced or eliminated during the process of releasing or unlocking the buckle tongue.

The spring elements may be molded parts of synthetic material. These molded parts could be placed into the buckle housing as independent components, or could be integrally formed as components of the buckle housing, especially on a cover thereof. The spring elements, in pairs, may be provided with a connecting element and may be placed in the buckle housing, where said spring elements are fixed due to their shape.

The spring elements may be in the form of clips, and that part of the buckle housing which is intended for insertion of the spring element may be appropriately shaped. Pocket-like recesses for receiving the spring elements may be provided in the buckle housing or in parts thereof especially in the bottom cover.

The position of the spring elements on either side of the insertion opening for the buckle tongue may be such that the inside width between the inner surfaces of the spring elements, which delimit the path for the buckle tongue, on the one hand is less than the inside width of the path, but on the other hand is not less than the width of those parts of the buckle tongue which enter the path.

It is also possible to have the inside width between the inwardly directed surfaces of the spring elements less than the width of those parts of the buckle tongue which enter the path.

The present invention has the advantage that not only are the aforementioned rattling noises precluded, but there is provided an additional guidance and fixation of the buckle tongue in the housing during insertion, in the latched state, and when the buckle is released.

The guidance and fixation of the buckle tongue in the housing during the latching and unlatching processes is effected by the spring elements which are placed or built into the buckle housing. These spring elements can have various shapes, so that said elements provide one or more force components transverse to the direction of insertion or ejection of the buckle tongue.

Thus, via the individual embodiments described above, forces can be applied which act essentially at right angles to the lateral narrow surfaces of the buckle tongue. Furthermore, the spring elements also can be disposed in such a way that the buckle tongue is acted upon by force components which also act counter to the direction of insertion of the tongue.

As previously mentioned, the spring elements can be provided with portions which project into the insertion path of the buckle tongue, and in particular in such a way that during insertion the tongue slides over these portions, especially in such a way that the tongue is acted upon by a force component which is essentially directed at right angles to the main surfaces of the tongue. This is preferably achieved by providing the portions with appropriate surfaces which rise in the direction of insertion of the buckle tongue.

The spring elements, of course, can be inventively shaped in such a way that various force components are applied which extend transverse to the direction of insertion or ejection of the buckle tongue.

As previously mentioned, pursuant to preferred embodiments of the present invention the spring elements of the buckle can be made as plastic injection molded parts which are either in one piece or can be easily joined together by clip connections. Since safety belts for motor vehicles must be mass produced in large quantities, every contribution for lowering the cost of fabrication, and for simplifying assembly, is of considerable significance.

DESCRIPTION OF PREFERRED EMBODIMENTS

Referring now to the drawings in detail, the conventionally assembled safety belt illustrated in FIG. 1 has a so-called two-plate housing 10; disposed between the two plates is a path 11 for a plate-like buckle tongue 12. The tongue 12 has an opening 13 (FIG. 2) in which a latching member 14, which is disposed orthogonally to the buckle housing plates 10 and to the buckle tongue 12, can engage in order to lock the belt buckle. In order to disengage the latching member 14 and thus open the buckle, there is provided a push button 15 on which are formed prong -like projections 16 which support the latching member 14. A compression spring 17 urges the latching member from above, so that it constantly presses in the latching position. In place of the pivotable push button 15, a non-illustrated sliding key also could be provided.

The path 11 for the buckle tongue 12 is open on one side toward the outside, where it forms a funnel-shaped insertion opening 18 for the tongue 12; on the opposite side, the path 11 is closed-off by a plate-like connecting member 19 for an anchoring element 20. A rivet or pin 21 serves to connect the buckle housing 10 with the connecting member 19. An ejector 22, which is longitudinally movable, is disposed in the central region of the path 11 and rests against two lateral ejector springs 23, which endeavor to push the ejector 22 in the direction of the insertion opening 18 for the buckle tongue 12. The tongue 12 contacts the ejector 22 when inserted.

The buckle housing 10, which is formed of two plates and absorbs the primary belt forces and feeds said forces via the anchoring element 20 into the vehicle, is covered externally by practical and attractive molded plastic covers, and in particular by a top cover 24 and a bottom cover 25. Together with a complementary configuration, these covers keep the insertion opening 18 free and allow access to the push button 15. Centering of the covers upon one another is preferably effected by pins and corresponding holes, with one such hole 26 being illustrated in FIG. 3. Furthermore, non-illustrated connecting screws are provided. The inner surfaces of the covers 24, 25 are profiled or shaped in order to fulfill various functions. For example, the bottom cover 25 has upright ribs for positioning and holding the housing 10. Furthermore, a ramp 28 is provided for the buckle tongue 12, which is inserted in the direction of the arrow 29 (FIG. 3).

The person, when using the safety belt buckles up, guides the buckle tongue 12 toward the opening 18 of the buckle and inserts the tongue into the path 11 of the housing 10 until the latching member 14 snaps into the opening 13; this can normally be felt and/or heard. To open the buckle, there is merely necessary to push upon the button 15, whereupon the latching member 14 moves out of the opening 13 from above and the buckle tongue 12, under the effect of the ejector 22, is pushed out of the path 11 and through the opening 18. Since the parts of the housing 10 and the buckle tongue 12, for manufacturing reasons and for simple handling, are dimensioned in such a way that the tongue is movable in the housing with play when the belt buckle is closed, there is repeatedly produced, especially on an uneven roadway and at critical engine speeds, rattling noises in the buckle due to the fact that the metal parts of the housing, the buckle tongue, and the latching member audibly strike one another, and in particular especially in the direction transverse to the longitudinal axis of the buckle, although also in other directions. This noise not only can be irritating, but, can also adversely affect the material of the aforementioned parts.

Figures 2A, 2B:
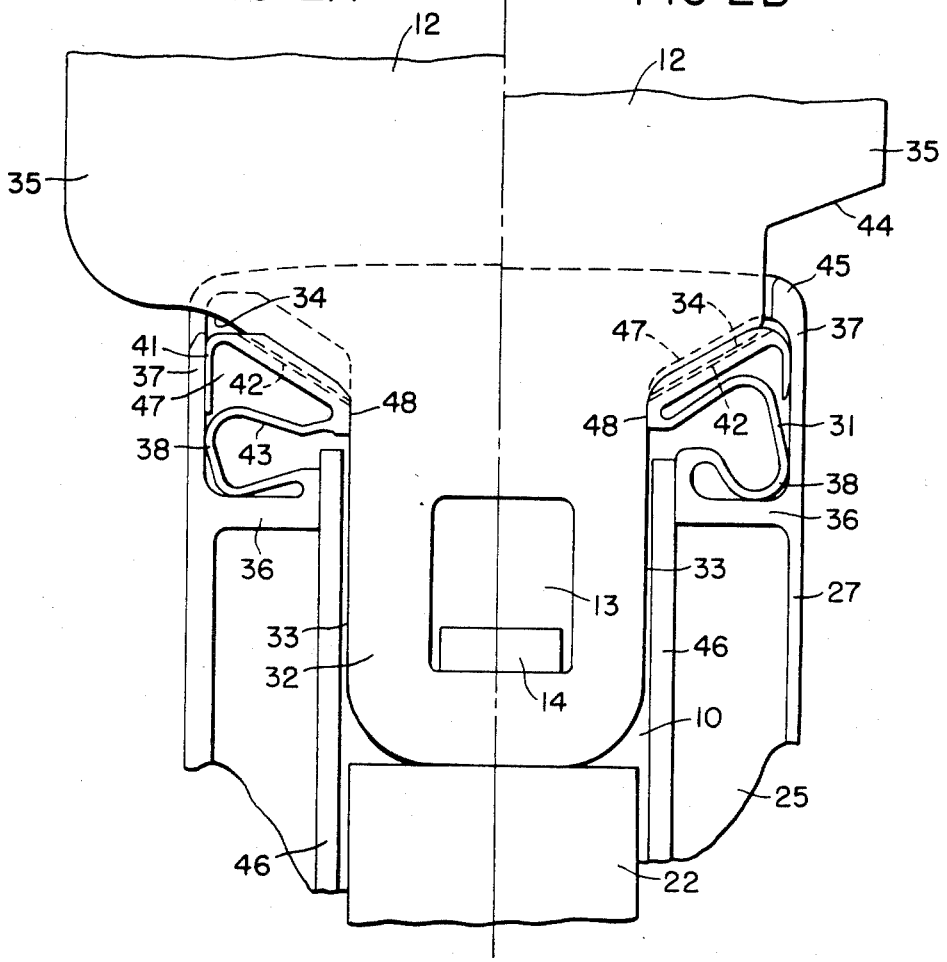
FIGS. 2A and 2B are plan views of two different inventive belt buckle portions on either side of the longitudinal center line thereof.
Figure 3:
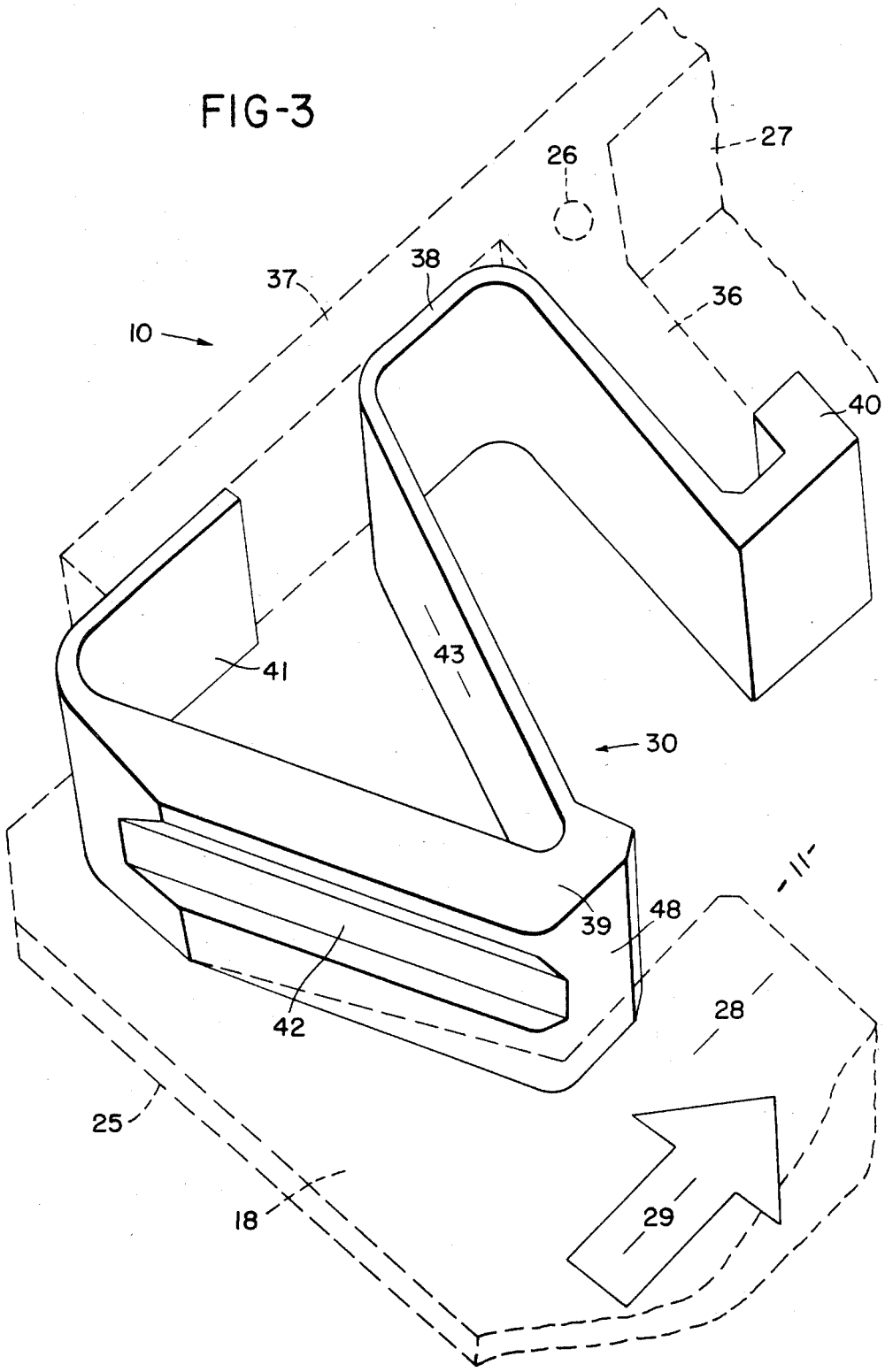
FIG. 3 is a diagrammatic view of one inventive embodiment of a spring element.

FIGS. 2A, 2B, and 3 show measures for preventing the formation of noise; these measures are in the form of spring elements 30, 31 which are disposed on both sides of the insertion opening 18 for the buckle tongue 12. These spring elements compensate for the aforementioned play between the referenced components of the buckle by contacting, guiding, and centering the buckle tongue 12 from the sides as the buckle tongue moves in the path 11. In addition, the spring elements stress the buckle tongue with a differentiated pre-stress counter to the direction of insertion. This results not so much in enhancing the effect of the ejector 22, but rather makes the ejector particularly unmistakable to feel when the latching action occurs during insertion. Thus, the requirement for hearing this latching action to a large extent becomes unnecessary; this is particularly advantageous since, for example after the engine has been started, hearing this action can be an unreliable test. Finally, the spring elements 30, 31 can also compensate for tilting of the buckle tongue 12.

In the embodiment of FIGS. 2 and 3, the spring elements 30, 31 are designed to cooperate with a buckle tongue 12 which has a stepped plan shape. The buckle tongue 12 has a front portion 32 which is intended for insertion into the path 11. The front portion 32 has parallel side edges 33 which are connected via inclined, outwardly extending edges 34 with a broader base part 35. The base part 35 contains the customary slot through which is looped the actual safety belt band (not illustrated). The spring elements 30, 31 act upon not only the buckle tongue front portion 32 with the edges 33, but also upon the base part 35 with the inclined edges 34. In so doing, frictional connections result in different directions. Even buckle tongues without inclined edges 34 can have the position thereof affected by the spring elements in such a way that no rattling noises result.

The spring elements 30, 31 are made of synthetic material which is flexible in a spring-like manner, and roughly approximate the shape of an S-shaped band, the thickness of the material varying. At the ends of the S-contour, extensions can be provided which in particular perform fastening and supporting functions. Due to the two oppositely directed curves of the S-configuration, a number of spring effects can be achieved.

The essential details of the spring elements will be described with the aid of the enlarged illustration of the spring element 30 of FIG. 3. With regard to manufacture, this spring element 30 is an independent element of the clip type, which during assembly of the buckle is inserted into the bottom cover 25 which for this purpose has an appropriate profiling, and in particular a holding rib 36, a supporting rib 37, and the appropriately wide ramp 28. The spring element 30 effectively fits in the space formed by these parts of the bottom cover 25. The spring element 30 is composed from a shape standpoint of the inner S-curve 38 and the outer S-curve 39. An undercut holding extension 40 for encircling the holding rib 36 is connected to the inner curve 38, while the outer curve 39 is provided with a supporting extension 41 which rests against the supporting rib 37. The curvature of the inner curve 38 also rests against the supporting rib 37. That portion of the outer curve 39 which is directed inwardly toward the ramp 28 has an inner surface 48 as an abutment surface, while the outwardly directed portion is reinforced or thicker and is provided on its outside with a groove which has a conical cross section and in which the associated inclined edge 34 of the base part 35 of the inserted buckle tongue 12 is disposed. As a result, a centering and fixing of the position of the buckle tongue in the direction transverse to the main plane thereof is effected. This eliminates the possibility of vibrational movement in this direction, so that in addition no noise related to such movement can result.

When the buckle tongue 12 is inserted into the opening 18 in the direction of the arrow 29, each of the inclined edges 34 presses against the deepest portion of the associated groove 42. As a result, the spring element 30 is tensioned; i.e. the S-configuration of the spring element is reduced in size in the direction of insertion. In other words, the S-curves are contracted or compressed. In so doing, the outer periphery of the S-contour of the spring element does not become wider because the inward deflection or movement of the spring element 30 is prescribed by the shape of the bottom cover 25 (the supporting rib 37 on the one band and the ramp 28 on the other hand), and because the central hand portion 43 between the S-curves 38 and 39 is forced to assume a flat S-shape. In so doing, the extension 41 slides along the supporting rib 37 in the direction of the arrow 29 until it nearly butts against the inner curve 38.

While in FIG. 3 a spring element is illustrated which is independent of the bottom cover 25, FIGS. 2A and 2B show two spring elements 31 which are integrally formed on the bottom cover 25. Essentially, however, the spring elements 31 have the same configuration as does the independent spring element 30. The two embodiments of FIGS. 2A and 2B, which are shown on opposite sides of the longitudinal central line of the buckle, differ from one another not only by slightly different configurations of the S-shapes of the spring element 31, but also, and especially, by different contours of the respective buckle tongues 12. Whereas the buckle tongue of FIG. 2A merges directly into the base part 35 from the inclined edge 34 via a gentle curvature, in FIG. 2B a step 44 is connected to the inclined edge 34 before the full width of the base part 35 is reached. These different contours for the buckle tongues also entail different shapes of the bottom cover 25. In the embodiment of FIG. 2A, the supporting ribs 37 end at the level of the outer S-curve 39 of the spring element 31, whereas in the embodiment of FIG. 2B, the supporting ribs 37 are advanced toward the insertion opening 18, where they are bent slightly inwardly so that an edge piece 45 results. The differences between the embodiments of FIGS. 2A and 2B show that the spring elements can be utilized with different buckle tongues.

For the buckle of FIGS. 2A and 2B, a U-shaped buckle housing 10 is provided; i.e. the longitudinal edges of the lower buckle plate are bent upwardly in a U-shape, so that upright legs 46 result between which the non-illustrated upper buckle plate is mounted in the manner of a cover. With this customary manner of construction, the front portion 32 of the buckle tongue 12 is guided in the path 11 not only from above and from below, but also along the side edges 33 by means of the legs 46. However, in so doing, there results the aforementioned play between the referenced components which leads to the formation of noise. To compensate for and hence avoid noise, the spring elements 31 are provided which, in appropriate recesses 47 of the bottom cover 25, can move in a spring-like manner in the longitudinal direction of the buckle. Those boundaries of the recesses 47 disposed toward the insertion opening 18 are shown in dashed lines in FIGS. 2A and 2B. This also shows that the spring elements 31, in the illustrated latched state of the buckle, are compressed in the longitudinal direction of the latter, and in particular to such an extent that each inner S-curve 38 contacts the associated surface of the holding rib 36, where it is supported. In so doing, the characteristic curve of the affected spring element 31 is altered in a manner which can be clearly felt by a person inserting the buckle tongue 12. Numerous shapes are possible in the vicinity of the two S-curves 38, 39 in order to achieve this effect. The characteristic of the spring elements should achieve a maximum compressive force during insertion when the curve 38 is supported, and from then to the moment the latching member 14 engages in the opening 13 should require only a slight compressive force in order to be able to feel the engagement.

As can be seen in FIGS. 2A and 2B, those surfaces of the spring elements 31, which are directed toward the middle of the buckle, rest against the side edges 33 of the buckle tongue 12 and thereby position the latter. In this connection, the inside width between the inner surfaces 48 of the spring elements 31 is less than the inside width between the inner surfaces of the legs 46, but not less than the width of the front portion 32 of the buckle tongue 12. With this manner of construction, the coefficients of friction which become effective during insertion of the buckle tongue are kept particularly low. However, it also is possible to have the inside width between the inner surfaces 48 slightly less than the width of the front portion 32 of the buckle tongue. The approach, during insertion, of the inclined edges 34 of the tongue 12 to the respective outer curves 39 with their conical grooves 42 additionally centers the buckle tongue and prevents the latter from tilting.

Figure 4:
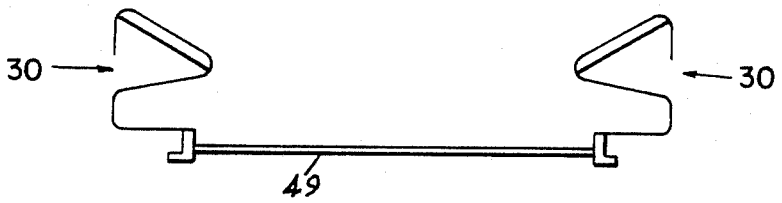
FIG. 4 shows two spring elements which are connected as an independent component by a connector.

The spring elements illustrated in FIG. 4 as such correspond to the spring elements 30 of FIG. 3, yet, in this embodiment are, rigidly interconnected by means of a connecting element 49. It is thus a question of an integral injection molded plastic part, which during assembly of the buckle, is placed in the bottom cover 25, thus simplifying manufacture.

Figure 5:
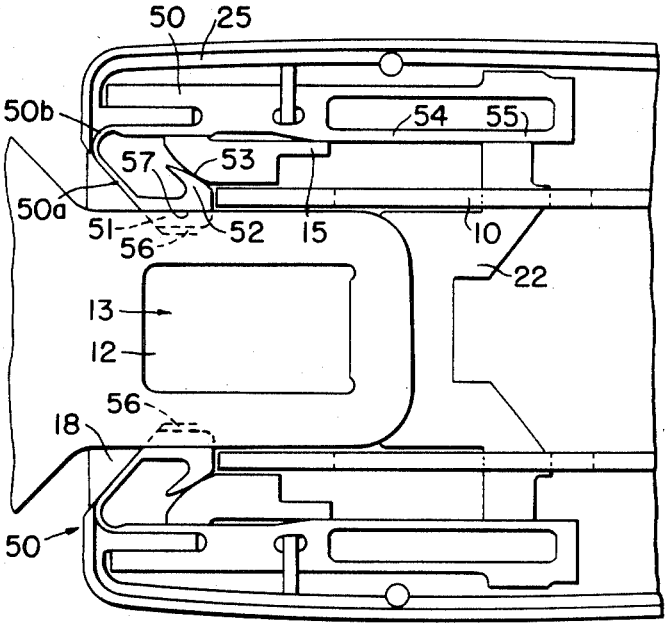
FIG. 5 is a plan view of a further embodiment of the inventive buckle.

FIG. 5 shows a further embodiment of an inventive buckle. In contrast to the previously described embodiments, the spring elements 50 have a different shape, and in particular also require a different introduction and transfer of force to the buckle tongue.

Each spring element 50 has a curved upper portion 50*a*, and a member 54 which is connected thereto and essentially extends along the buckle. Side portions 51 of each of the spring elements 50 project into the path 11 of the buckle tongue 12. The portions 51 are disposed in pocket-like recesses 56 in the bottom cover 25 of the buckle housing 10. The portions 51 have a slope which rises in the direction of insertion of the buckle tongue 12, in order during insertion to be able to press the buckle tongue upwardly and thus hold said buckle tongue in position.

The free end of the upper part 50*a* of the spring element 50, as an extension 52, is similarly provided with a slope. The ramp-like extensions 52 cooperate with wedge-shaped projections 53 on the forward lower edge of the push button 15.

Via a portion 50*b* which is offset and curved relative to the lateral outer surfaces of the buckle, the spring elements 50 continue in the members 54, which are essentially parallel to one another and are disposed in the longitudinal direction of the buckle. The members 54 can be referred to as resilient guide ways, since on the one hand the members 54 introduce into the buckle housing 10 clamping forces which will be described in detail subsequently, and on the other hand extensions thereof as guide portions 55 serve to laterally delimit and guide the ejector 22. In this connection, it is important that the guide portions 55 also be resilient, so that the ejector 22 can be guided free of play. By an appropriate alteration of the supporting cross section of the guide portions 55, the spring effect can be kept small over the greatest extent of the stroke of the ejector, and only increases in the vicinity of the engaging or locking point of the buckle tongue. This makes possible a particularly easy and advantageous overall handling of the buckle. Correspondingly, the positioning of the front end 50*a* of the spring element 50 also can be affected.

The spring element 50 in the embodiment of FIG. 5 functions as follows.

When the buckle tongue 12 is introduced into the buckle housing 10 via the funnel-shaped insertion opening 18, the front end 32 thereof first runs up on the portion 51 of the spring elements 50, and the tongue is then guided upwardly. As a result, an initial guidance of the buckle tongue is achieved. As soon as the tongue 12 has been pressed forward to such an extent that the latching member 14 engages in the opening 13 of the buckle tongue 12, the push button 15 also is pivoted into its forward end position, with the wedge-shaped projections 53 of the push button 15 pressing upon the ramp-like extensions 52 of the spring elements 50 and effecting a displacement of the curved portion 50*a* of the spring elements 50 in the direction toward the buckle tongue 12. In so doing, the lateral contact surfaces 57 of the spring elements 50 are pressed against the buckle tongue 12 and clamp the latter. The clamping forces are then introduced into the buckle housing 10 via the members 54, which are disposed parallel to the longitudinal axis of the buckle. In this forward position of the buckle tongue 12, the latter also is pressed upwardly along the portions 51 to such an extent that the buckle tongue 12 is clamped in the direction normal to its main surfaces between the portions 51 and the upper housing parts.

As described in detail in connection with the previous embodiments, by appropriate construction of the lateral contact surfaces 57, a partially tight embracing of the buckle tongue 12 is achieved, as a result of which the guidance and clamping of the tongue 12 is further improved.

The important thing is that the clamping forces of the spring elements 50 not be initiated until the region of the engagement point of the buckle tongue 12 in order to achieved insertion forces which are as small as possible. There is at the same time connected therewith the advantage that the clamping forces of the spring elements 50 are negated during the unlatching process of the buckle tongue 12 before the latter is ejected by the ejector 22, thus assuring a reliable ejection of the tongue 12.

This easy operation and high functional reliability is achieved with the embodiment of FIG. 5 in particular by the appropriate design of the extensions 52 and projections 53.

The inventive embodiment prevents a self-locking from occuring between the extensions 52 and projections 53, whereby the spring elements 50 otherwise could be shifted to the side when the buckle tongue 12 is inserted.

By appropriate structural adaptation, the advantages described in connection with the previous embodiments also can be realized with the embodiment of FIG. 5.

The present invention is, of course, in no way restricted to the specific disclosure of the specification and drawings, but also encompasses any modifications within the scope of the appended claims.

What I claim is:

1. A buckle for safety belts in passenger carrying vehicles; the buckle includes a housing means, and a tongue which is adapted to be connected to a belt and can be inserted into an insertion opening of said housing means and into a path therein for said tongue; said tongue can be locked in said housing means by at least one latching member, and is acted upon by a spring-loaded ejector; the improvement comprises;

at least one spring element disposed in said housing means in the vicinity of said insertion opening for said buckle tongue; each of said spring elements has at least one abutment surface which projects laterally into said path which said tongue must traverse upon its insertion into said housing means; said at least one abutment surface of each of said spring elements projects laterally into said path in such a way that a tongue present therein is acted upon transverse to its direction of insertion or ejection;

each of said spring element having an approximately S-shape including an S-path therewith, with the S-path being disposed in or parallel to the plane of said buckle tongue; each spring element having an outer S-curve which is closest to said insertion opening of said housing means; said outer S-curve acting upon the affected sides of said buckle tongue with respective force components counter to and transverse to the direction of insertion.

2. A buckle according to claim 1, in which said insertion opening of said housing means for said buckle tongue has two narrow sides, with a respective spring element being disposed at each of said narrow sides.

3. A buckle according to claim 2, in which said spring elements are disposed symmetrically relative to one of said central longitudinal axis of said housing means and said path thereof for said buckle tongue, and are disposed in an appropriate mirror-inverted manner.

4. A buckle according to claim 1, in which, with reference to the location at which said latching member engages said buckle tongue, each of said spring elements is disposed in said housing means so that an inserted buckle tongue comes into contact with said spring elements shortly before reaching this location, and upon reaching this location, said tongue is subject to stress exerted by said spring elements.

5. A buckle according to claim 1, in which said spring elements are shaped as well as disposed in said housing means so, that they act upon an inserted buckle tongue with a force component which is essentially directed at right angles to narrow lateral surfaces of said tongue.

6. A buckle according to claim 1, in which said spring elements are shaped as well as disposed in said housing means so that they act upon an inserted buckle tongue with a force component which acts counter to the direction of insertion of said tongue.

7. A buckle according to claim 1, in which said outer S-curve of each spring element has a portion which extends straight and is provided with a groove which is directed toward said insertion opening of said housing means for receiving an edge of a buckle tongue.

8. A buckle according to claim 7, in which said groove of said spring element has a trapezoidal cross section which widens in the direction toward said insertion opening of said housing means.

9. A buckle according to claim 1, in which each S-shaped spring element is band-like and has a flat, rectangular cross section; the inner space of said insertion opening of said housing means is closed off toward the side by one of said spring elements.

10. A buckle according to claim 9, in which that end of said S-shaped spring element closest to said insertion opening of said housing means continues via a flange-like extension which is bent toward the interior of said housing means away from said insertion opening thereof.

11. A buckle according to claim 10, in which said flange-like extension is formed on said spring element at such an angle that the closure of said insertion opening of said housing means is effected with prestress at the affected sides via said spring element.

12. A buckle according to claim 10, in which that end of said S-shaped spring element remote from said insertion opening of said housing means is provided with a further extension which serves as an abutment surface for further parts of said housing means.

13. A buckle according to claim 12, in which said housing means is provided with a holding rib, and in which said further extension of said spring element embraces said holding rib and fixes the position of said spring element in said housing means.

14. A buckle according to claim 1, which said spring elements are shaped as well as disposed in said housing means so that they act upon an inserted buckle tongue with a force component which is essentially directed at right angles to the main surfaces of said tongue.

15. A buckle according to claim 14, in which each of said spring elements includes a portion thereof which projects into said insertion path for said buckle tongue, and which is provided with a surface extending upwardly toward the exterior of said buckle.

16. A buckle according to claim 1, which includes a push button for releasing said latching member from said buckle tongue; said push button is provided with projections; and in which said spring elements are provided with respective ramp-like extensions which are adapted to positively connect with said projections of said push button in the latched state of said buckle; said projections stress said ramp-like extensions in the direction toward said buckle tongue, and thereby securely hold the latter.

17. A buckle according to claim 16, in which each of said spring elements includes a member thereof for transferring clamping forces into said housing means.

18. A buckle according to claim 17, in which said member for transferring clamping forces essentially extends in said housing means in the longitudinal direction of said buckle and is provided with a portion for laterally guiding said ejector.

19. A buckle according to claim 1, which the shape of said spring elements, with reference to the curvature, length, build-up of material, as well as from adjacent parts of said housing means with which they come into contact when they are displaced, is such that during insertion of said buckle tongue, and during its progress up to the moment of engagement, the spring forces change, and in particular are reduced prior to engagement to such an extent that a person putting on the buckle can distinctly feel the engagement.

20. A buckle according to claim 7, in which said spring elements and the acted-upon components are coordinated so that the clamping forces of said spring elements are immediately eliminated when said buckle tongue is released.

21. A buckle according to claim 7, in which said spring elements are molded parts of synthetic material.

22. A buckle according to claim 21, in which said spring elements are independent components which are placed in said housing means.

23. A buckle according to claim 22, in which said spring elements are integrally formed on components of said housing means.

24. A buckle according to claim 21, in which two spring elements are connected into a unit by means of a connecting element, with said unit being placed in said housing means, where it is fixed by the shape of the latter.

25. A buckle according to claim 7, in which said spring elements are clips, and in which said housing means includes an appropriately shaped part which is adapted for the insertion of said spring elements.

26. A buckle according to claim 7, in which said housing means includes pocket-like recesses for receiving said spring elements.

27. A buckle according to claim 7, in which a spring element is disposed on both sides of said insertion opening so that an inside width between the inwardly directed surfaces of said spring elements, which surfaces delimit said path for said buckle tongue, on the one hand is is less than the corresponding inside width of said path, and on the other hand is at least as great as the corresponding width of that portion of said tongue which enters said path.

28. A buckle according to claim 7, in which the inside width between inwardly directed surfaces of said spring elements is less than the width of that portion of said buckle tongue which enters said path of said housing means therefor.

* * * * *